US007169097B1

(12) United States Patent
Stearns

(10) Patent No.: US 7,169,097 B1
(45) Date of Patent: Jan. 30, 2007

(54) EXERCISE MACHINE

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 298 days.

(21) Appl. No.: 10/316,981

(22) Filed: Dec. 9, 2002

Related U.S. Application Data

(63) Continuation of application No. 09/374,937, filed on Aug. 16, 1999, now Pat. No. 6,491,608, which is a continuation of application No. 08/881,489, filed on Jun. 24, 1997, now Pat. No. 5,938,575, which is a continuation-in-part of application No. 08/719,900, filed on Sep. 25, 1996, now Pat. No. 5,692,997, which is a continuation of application No. 08/279,281, filed on Sep. 2, 1994, now abandoned, which is a continuation-in-part of application No. 08/077,320, filed on Jun. 14, 1993, now Pat. No. 5,346,447, which is a continuation of application No. 07/793,859, filed on Nov. 18, 1991, now abandoned.

(51) Int. Cl.
*A63B 26/00* (2006.01)

(52) U.S. Cl. ..... 482/142; 482/96; 482/140

(58) Field of Classification Search ..... 482/142, 482/95, 96, 72, 907, 137–9, 123; D21/676, D21/686, 690
See application file for complete search history.

(56) References Cited

U.S. PATENT DOCUMENTS

| | | | | |
|---|---|---|---|---|
| 248,121 | A | 10/1881 | Tuttle | |
| 1,456,317 | A | 5/1923 | Lauer | |
| 1,950,174 | A | 3/1934 | Harrison | 272/58 |
| 3,005,633 | A | 10/1961 | Rimer | 272/58 |
| 3,446,503 | A | 5/1969 | Lawton | 272/79 |
| 3,491,998 | A | 1/1970 | Lyon | 272/58 |
| 3,589,715 | A | 6/1971 | Mark | 272/58 |
| 3,716,230 | A | 2/1973 | Mark | 272/58 |
| 3,761,081 | A | 9/1973 | Simmons | 272/58 |
| 3,782,717 | A | 1/1974 | Berlin | 272/58 |
| 3,976,058 | A | 8/1976 | Tidwell | 128/25 R |

(Continued)

*Primary Examiner*—Lori Amerson

(57) ABSTRACT

An exercise machine (10-101) is provided having a platform (12-121) on which a user (14-141) is supported in a reclining position with the weight of the user (14-14G) being utilized as a resistance which may be selectively varied to the various exercises which may be performed on the exercise apparatus (10-101). A lever (20-201) is pivotally connected (30-321) to the platform (12-121) with the lever being actuated by the user for raising one end of the platform (12-121) with respect to a pivot point with resistance to such raising being varied by the pivotal mounting of the lever (20-201) on the platform (1 2121). Two of the various embodiments (FIGS. 13–16) include a base support (41F, 41G) having a rail (42F, 42G) on which a lever (20F, 20G) has a roller (47F, 47G) mounted for riding movement thereon and pivotally connected (32F, 32G) to a lower leg (62F, 62G) for pivotal movement. Other embodiments (FIGS. 17–18 include a lever (20H-20*i*) having telescoping members with an inner one (54H-541) for such telescoping member being selectively fixed to a rail (41H-411). Such inner telescoping member (54H-541) reciprocates within an outer telescoping member (56H–561) as the platform is raised and lowered. Another embodiment of the invention includes a lower body frame which may be rotated with lower limbs, an upper body frame which may be rotated with upper limbs and a weight stack-cable system for resisting rotation of the lower body frame and/or the upper body frame. A further embodiment of the invention (FIGS. 23–27) includes an upper back support (210) interconnected by a connecting linkage with a lower body actuator (240) for coordinated simultaneous movement upon a lifting action exerted by limbs of a user against either the upper back support (210) or the lower body actuator (240).

15 Claims, 16 Drawing Sheets

U.S. PATENT DOCUMENTS 4,387,893 A 6/1983 Baldwin ..... 272/118
4,489,936 A 12/1984 Dal Monte ..... 272/120
4,627,614 A 12/1986 de Angeli ..... 272/117
4,632,390 A 12/1986 Richey ..... 272/120
4,729,562 A * 3/1988 Pipasik ..... 482/97
4,750,741 A 6/1988 Smolanovich ..... 272/144
4,752,067 A 6/1988 Colonello ..... 272/93
4,768,776 A 9/1988 Giannotti ..... 272/72
4,815,732 A 3/1989 Mahvi ..... 482/142
4,902,003 A 2/1990 Buoni ..... 272/93
4,949,958 A 8/1990 Richey ..... 482/96
4,953,857 A 9/1990 Lemire
5,037,090 A 8/1991 Fitzpatrick ..... 272/134
5,056,779 A 10/1991 Webb ..... 482/137
5,060,939 A * 10/1991 Oswald et al. ..... 482/142
5,346,447 A * 9/1994 Stearns ..... 482/96
5,545,114 A 8/1996 Gvoich ..... 482/140
5,616,106 A 4/1997 Abelbeck ..... 482/130
5,665,041 A * 9/1997 Hsieh ..... 482/142
5,676,628 A 10/1997 Chen ..... 482/142
5,692,997 A * 12/1997 Stearns ..... 482/100
5,931,768 A 8/1999 Amesquita ..... 482/140
5,938,575 A * 8/1999 Stearns ..... 482/142

* cited by examiner

EXERCISE MACHINE

CROSS REFERENCE TO RELATED APPLICATIONS

This is a continuation of application Ser. No. 09/374,937 filed Aug. 16, 1999, now U.S. Pat. No. 6,491,608; which is a continuation of application Ser. No. 08/881,489 filed Jun. 24, 1997, now U.S. Pat. No. 5,938,575; which is a continuation-in-part of application Ser. No. 08/719,900 filed Sep. 25, 1996, now U.S. Pat. No. 5,692,997; which is a continuation of application Ser. No. 08/279,281 filed Sep. 2, 1994, abandoned; which is a continuation in part of application Ser. No. 08/077,320 filed Jun. 14, 1993, now U.S. Pat. No. 5,346,447; which is a continuation of application Ser. No. 07/793,859 filed Nov. 18, 1991, abandoned.

BACKGROUND OF THE INVENTION

1. Field of the Invention

This invention relates to a variable resistance exercise machine and more particularly to an exercise machine having a platform to support a user in a reclining position with resistance to the exercise provided by the weight of the user.

2. Description of Prior Art

As indicated in U.S. Pat. No. 4,489,936 dated Dec. 25, 1984, a relative inexpensive and simple exercise board or machine has been utilized heretofore which is adapted particularly for home use. As shown in this patent, a platform or board is provided to support a user in a reclining position with the weight of the user providing resistance to the exercises. A movable frame having a single nonadjustable pivot axis is actuated by the user and may be positioned at selected fulcrum points along the platform to provide the desired resistance. Such an exercise machine is relatively inexpensive and can be utilized for exercising various body muscles.

SUMMARY OF INVENTION

The present invention is directed to an exercise machine in which a platform is utilized to support a user in a reclining or supine position with the weight of the user providing resistance to the exercises, the level of which may be adjusted with the machine. A lever is pivoted to one end of the platform and a plurality of spaced pivot axes on the lever permits the selection of a predetermined fulcrum point for the lever. Upon pivoting of the upper extending end of the lever by the user, the adjacent end of the platform is raised along with the body of the user. By varying the pivot axis or fulcrum point, the resistance is likewise varied thereby to permit the machine to be used with users of various strengths.

In one embodiment of the invention a seat supporting the lower torso of the user is pivotally mounted on the platform for relative pivotal movement upon pivoting of the lever for raising the lower body of the user supported on the seat and exercising pelvic muscles. Another embodiment provides a lower rail on which the lower end of the lever is supported for movement therealong upon pivoting of the lever by the user. Such an arrangement facilitates the movement of the lower end of the lever, which might be difficult, if supported on a thick plush carpet for example.

It is an object of this invention to provide an exercise device to support a user in a reclining position and with the resistance to the exercises provided by the weight of the user supported on a platform of the exercise device.

An additional object of this invention is to provide such an exercise machine which is adapted particularly for home use and may be easily folded and stored under a bed or the like.

Another object is to provide such an exercise machine in which the resistance may be easily varied for users of different strengths.

Other objects, features, and advantages of this invention will become more apparent after referring to the following specification and drawing.

DESCRIPTION OF THE INVENTION

Figure 1:
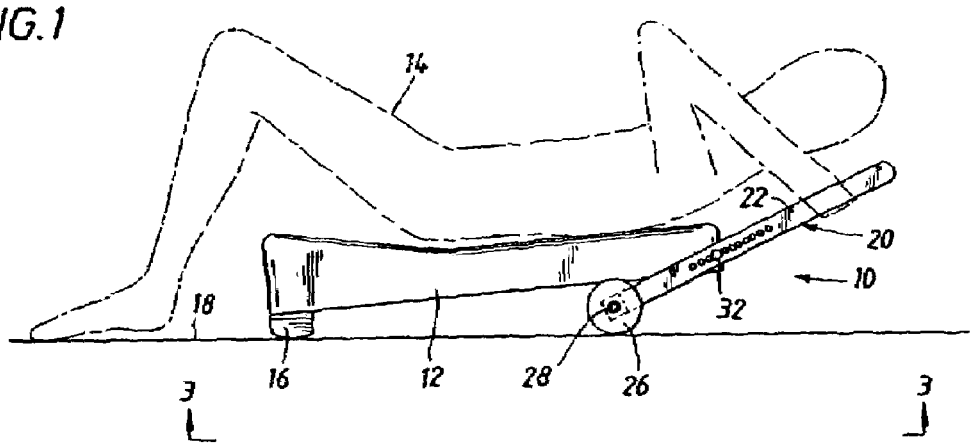
FIG. 1 is a side elevation of one embodiment of the exercise machine comprising the present invention in which a user is in a reclining position on a platform of the machine and the weight of the user provides resistance against pivoting of a variable position lever for raising of the platform.

Twelve different embodiments of exercise machines of the present invention are illustrated in the drawings with separate embodiments shown in FIGS. 1–3, FIGS. 4–6, FIGS. 7–9, FIG. 10, FIG. 11, FIG. 12, FIGS. 13 and 14, FIGS. 15, 16, 17 and 18, FIGS. 19–22 and FIGS. 23–27. The variable resistance provided for the exercise machine, of FIGS. 1–18 of these embodiments is provided by the weight of the user supported in a reclining position on a body supporting platform of each of the embodiments and a lever pivotally connected to an end of the platform. A weight stack provides added resistance for the embodiment of FIGS. 19–22. A connecting linkage extends between the upper back support and lower body actuator in the embodiment of FIGS. 23–27 to provide a coordinated movement of the upper back support and lower body actuator. The exercise machines are actuated by one of the following actions:

(1) by the user manually gripping a bar or hand grip adjacent one end of the exercise machine and exerting a pulling force;

(2) by the user exerting a lifting action by his thigh or upper leg for feet against a pad over the platform; or (3) by the user exerting a combination of actions (1) and (2) above.

An exercise machine in accordance with the above by utilizing the weight of the user as a variable resistance is relatively simple and inexpensive. Various muscles or muscle groups may be exercised by the present invention including upper and lower abdominal muscles, pelvic muscles, and specific arm and leg muscles.

Figure 2:
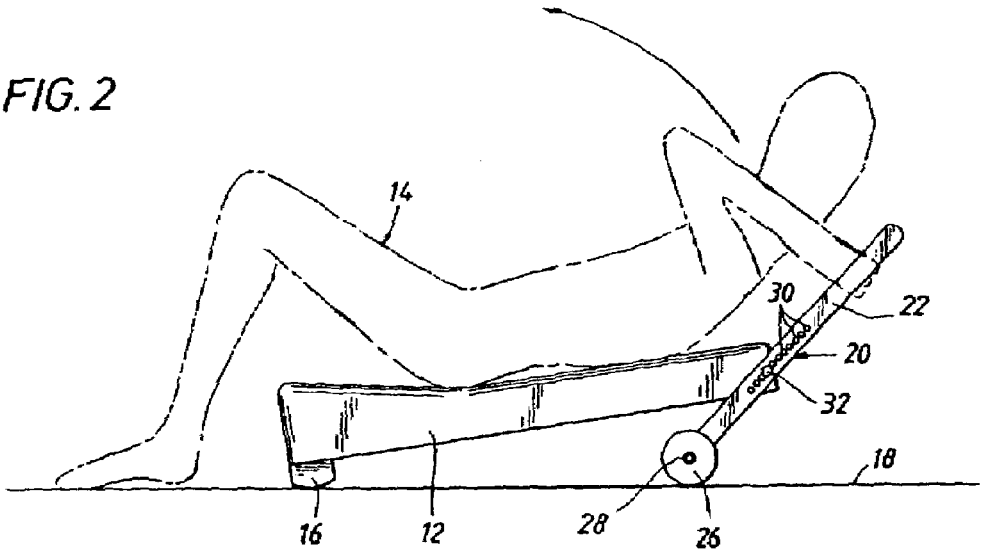
FIG. 2 is a side elevation of the exercise machine of FIG. 1 and shows an end of the platform raised by the user exerting a pulling force on the lever.
Figure 3:
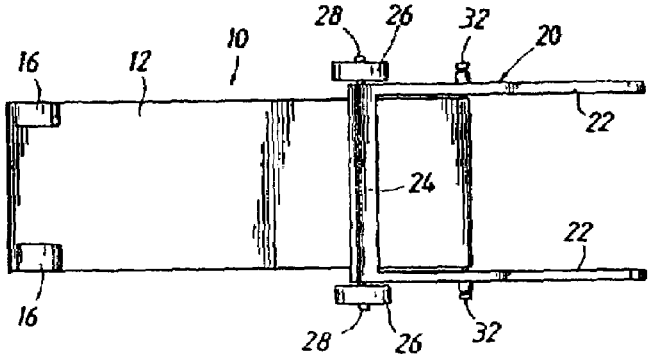
FIG. 3 is a bottom view of the exercise machine shown in FIGS. 1 and 2 taken generally along line 3—3 of FIG. 1.

Embodiment of FIGS. 1–3

Referring first to the embodiment shown in FIGS. 1–3, an exercise machine is shown generally at 10 having a platform 12 to support a user 14 shown in broken lines in a supine position with the weight of user 14 being applied downwardly against platform 12. Platform 12 includes legs 16 supported on a supporting surface 18 such as a floor or carpet on the floor. A lever shown generally at 20 has a pair of parallel arms 22 connected by a lower horizontal base or bar 24 on which rollers 26 are mounted for rotation on axles 28. A plurality of spaced openings 30 are spaced along the length of each lever arm 22 and a spring loaded plunger pin 32 is received within a selected opening 30 and an aligned opening in platform 12 to mount lever 20 for pivotal movement about a pivot axis. The exercise machine 10 is shown in a rest position in FIG. 1 and is shown in a raised actuated position in FIG. 2.

In operation, user 14 grips lever arms 22 manually and pulls upwardly to pivot lever 20 about the pivot axis formed by plunger pins 32 thereby to raise the associated end of platform 12 to the position shown in FIG. 2 with the resistance to such movement provided by the body weight of user 14 on platform 12. Such exercise is known as "crunching" for the exercise of upper abdominal muscles. It is apparent that lengthening the distance between rollers 26 and plunger pins 32 increases the force required by user 14 to pivot lever 20. Such distance may be increased or decreased selectively.

From the foregoing, a relatively simple exercise machine 10 has been provided particularly for home use for easily storing under a bed or the like. The exercise is performed with a selectively variable resistance provided from the weight of the user 14 during the entire movement of lever 20 to an uppermost position and during return of lever 20 to a rest position as shown in FIG. 1.

Figure 4:
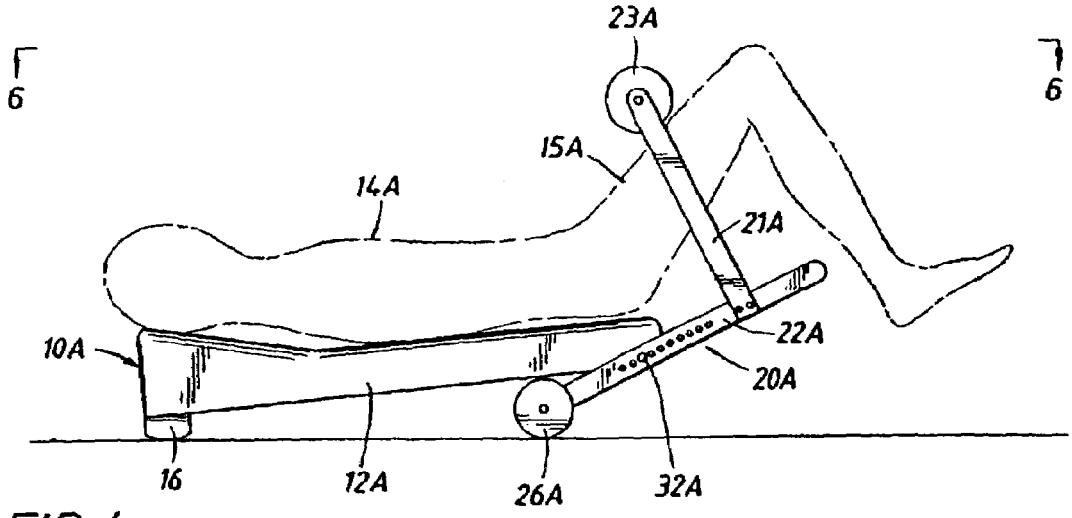
FIG. 4 is a side elevation of another embodiment of an exercise machine in accordance with the present invention in which the thigh or upper leg of the user is utilized for exerting a force on the lever for raising an end of the platform supporting the user in a reclining position.
Figure 5:
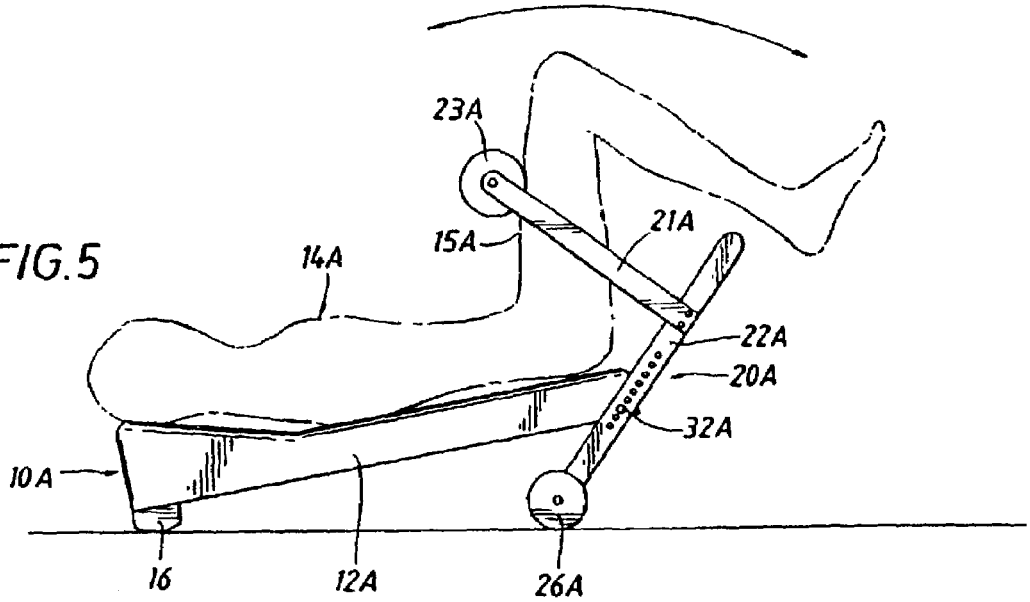
FIG. 5 is a side elevation of the exercise machine of FIG. 4 showing the lever actuated by the thighs of the user thereby pivoting the lever to a position which raises the end of the platform.
Figure 6:
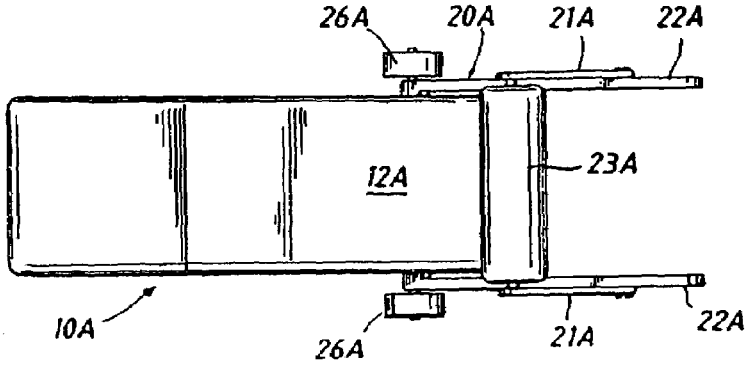
FIG. 6 is a top view of the exercise machine of FIGS. 4 and 5 looking generally along line 6—6 of FIG. 4.

Embodiment of FIGS. 4–6

Referring now to the embodiment shown in FIGS. 4–6, exercise machine 10A is shown having a lever 20A including a pair of lever arms 22A selectively mounted for pivotal movement on an end of platform 12A in a manner similar to the embodiment of FIGS. 1–3. A pair of upper support arms 21A are secured to lever arms 22A and extend upwardly therefrom. An upper leg pad 23A is mounted for rotation on the upper ends of support arms 21A. Such pad is adapted for contact by the upper legs or thighs 15A of user 14A. In operation, a lifting force, applied by thighs 15A against leg pad 23A, pivots lever 20A to the position shown in FIG. 5 with the movement being resisted by the weight of user 14A on platform 12A. As lever arms 22A pivot about pins 32A, rollers 26A roll a small distance as the entire machine pivots about legs 16. Thus, the actuating force in the embodiment of FIGS. 4–6 is applied by thigh 15A of user 14A for the exercising of the lower abdominal muscles.

Figure 7:
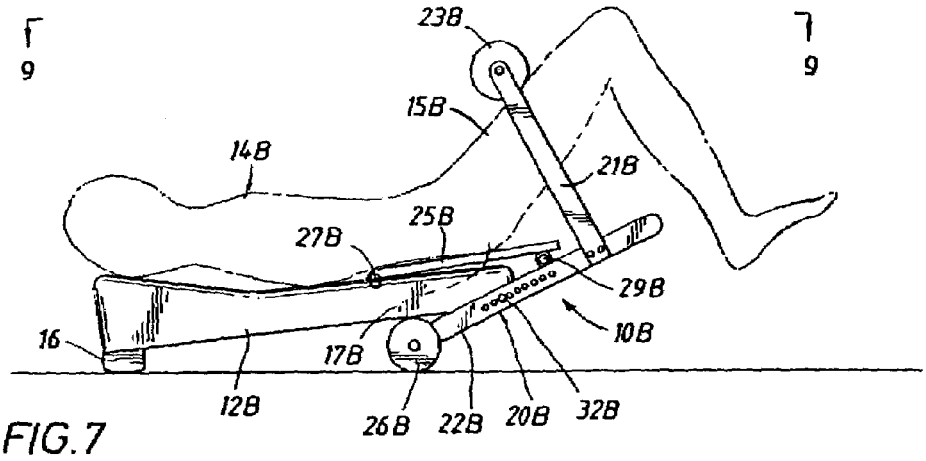
FIG. 7 is a side elevation of a further embodiment of this invention in which a seat is pivotally mounted on the platform for supporting the buttocks or lower torso of a user with the lever and seat being pivoted upon an upper movement of the lever from a force exerted by the thighs of the user.
Figure 8:
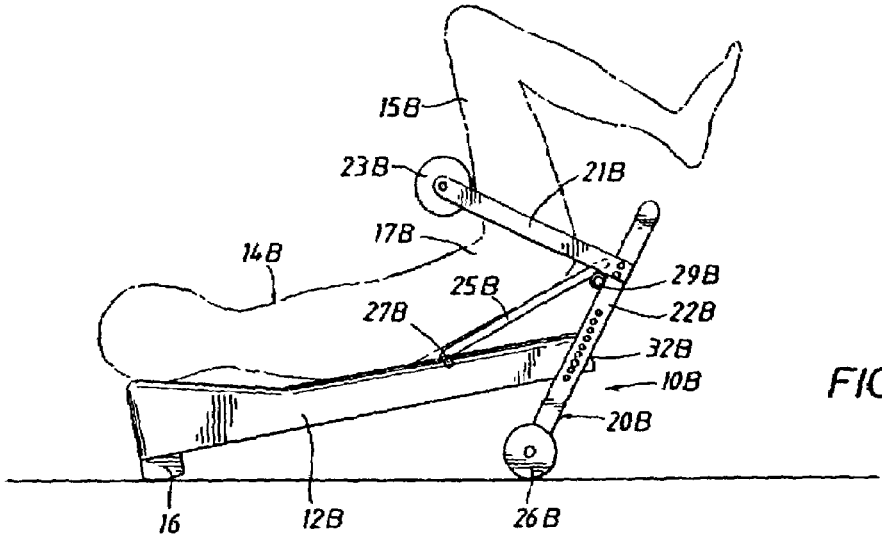
FIG. 8 is a side elevation of the exercise machine of FIG. 7 showing the lever and seat pivoted to an upper position by the thigh of a user supported in a supine position on the platform.
Figure 9:
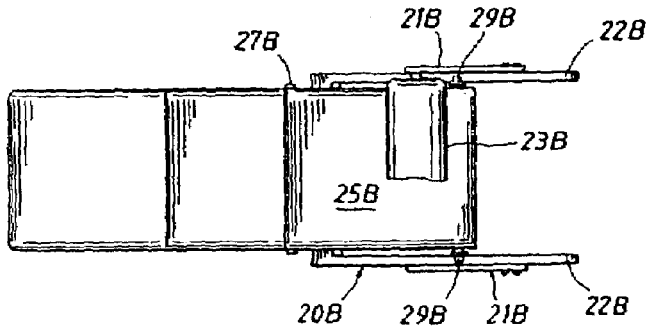
FIG. 9 is a top plan of the exercise machine of FIGS. 7 and 8 taken generally along line 9—9 of FIG. 7.

Embodiment of FIGS. 7–9

Referring now to FIGS. 7–9, an additional embodiment of the exercise machine of the present invention is illustrated at 10B and includes a platform 12B having a lever 20B selectively pivotally mounted at 32B to platform 12B. A leg pad 23B is mounted on lever 20B as in the embodiment of FIGS. 4–6. In addition, a seat 25B has one end pivotally mounted 27B to platform 12B and has rollers 29B adjacent another end mounted on lever arms 22B for rolling movement thereon. The buttocks or lower torso 17B of user 14B is supported on seat 25B for exercising the pelvic muscles upon rotation thereof as shown in FIG. 8. In operation form the rest position of FIG. 7, upward movement of thighs 15B against leg pad 23B raises lever 20B to the position of FIG. 8 with seat 25B being raised by rollers 29B riding along lever arms 22B thereby to move the lower torso 17B to the position of FIG. 8 for exercising the pelvic muscles. As lever arms 22B pivot about pins 32B, rollers 26B roll a small distance as the entire machine pivots about legs 16.

Figure 10:
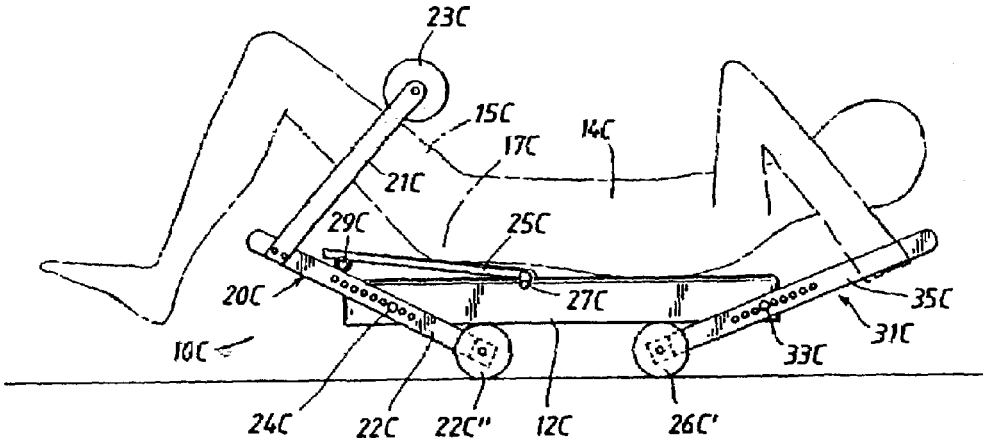
FIG. 10 is a side elevation of a further embodiment of the exercise machine of this invention showing a pair of levers mounted on opposed ends of the platform supporting the user with a seat beneath the lower torso of the user with the exercise machine actuated by a manual pulling force on one lever and a lifting force by the thigh of a user on the other lever.

Embodiment of FIG. 10

Referring now to FIG. 10, a further embodiment of the invention shows an exercise machine 10C having a platform 12C with the lower torso 17C of user 14C supported on a seat 25C pivotally mounted at 27C to platform 12C with rollers 29C configured to roll on lever arms 22C of lever 20C. A roller pad 23C is mounted for rotative movement on the upper ends of support arms 21C. Support arms 21 are secured to lever arms 20C which are selectively mounted to platform 12C for pivot rotation about pins 24C.

in addition, a second lever 31C is selectively pivotally mounted at 33C to platform 12C on the end thereof opposite lever 20C. Lever 31C includes lever arms 35C which are adapted to be gripped by user 14C as shown in broken lines in FIG. 10. In operation, user 14C pulls upwardly on arms 35C to pivot lever 31C about pins 33C upwardly while lifting thighs 15C upwardly against pad 23C to pivot lower lever 20C about pins 24C along with seat 25C as it pivots about pins 27C. Such operation exercises upper and lower abdominal muscles as well as the pelvic muscles. As in other embodiments described above, as lever arm 31C pivots about pins 33C, rollers 26C" roll a small distance, and as lever arms 22C pivot about pins 24C, rollers 26C" roll a small distance.

Figure 11:
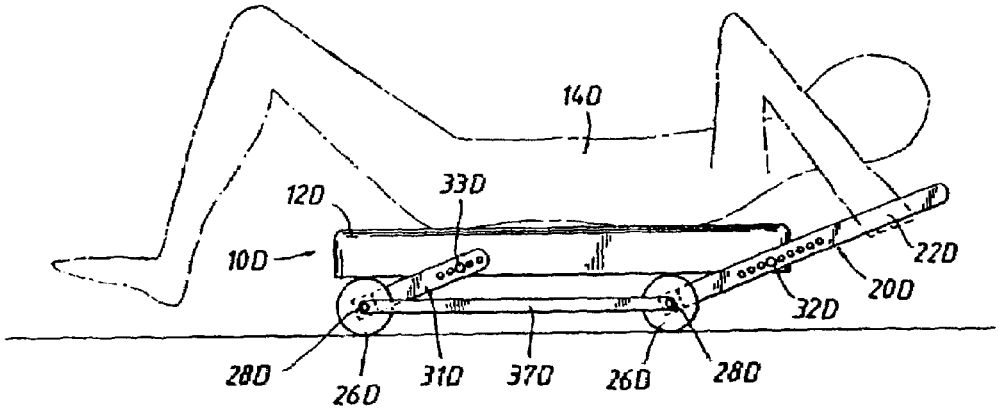
FIG. 11 is another embodiment of the exercise machine in which a four-bar linkage is utilized with the user of the machine gripping and pivoting one of the levers.

Embodiment of FIG. 11

A still further embodiment is shown FIG. 11 in which a four-bar linkage is provided to support platform 12D of exercise apparatus 10D. The four-bar linkage includes levers 20D and 31D mounted respectively for pivotal movement about pivots or pins 32D and 33D. Pins 32D and 33D may be mounted in various holes provided in lever arms 20D and 31D so as to selectively vary the amount of force exerted on the end of lever arms 20D and 31D to lift platform 12D vertically with the weight of user 14D pressing downwardly. A link 37D is pivotally connected at its ends to pivots 28D on rollers 26D.

A user 14D actuates exercise machine 10D by gripping lever arms 22D to raise levers 20D and 31D for lifting platform 12D against the variable resistance (depending on position of pins 32D and 33D) provided by the weight of user 14D.

Figure 12:
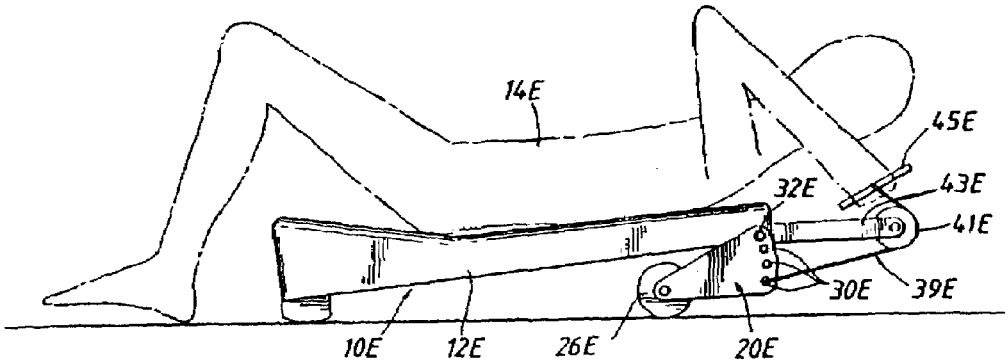
FIG. 12 is a further modification of the exercise machine in which the lever is actuated by a cable pulled by the user in supine position on the platform.

Embodiment of FIG. 12

Referring to FIG. 12, another embodiment of the invention is shown in which a lever 20E is mounted at 32E on each side of platform 12E for pivotal movement relative to platform 12E of exercise apparatus 10E. A roller 26E is mounted on lever 20E for rolling support on a supporting surface such as a floor. A plurality of spaced openings 30E in lever 20E are offset laterally from pivot 32E for selectively varying the anchoring position of the end of a cable shown generally at 39E. Pulleys 41E are mounted for rotation on support arms 43E secured to platform 12E and cables 39E extend about pulleys 41E. A handle 45E on a free end of each cable 39E may be gripped by user 14E for actuation of exercise machine 10E. Upon a pulling force exerted by user 14E on handles 45E, levers 20E pivot about pivots 32E to raise the adjacent end of platform 12E while lever E rolls a small distance on rollers 26E.

Figure 13:
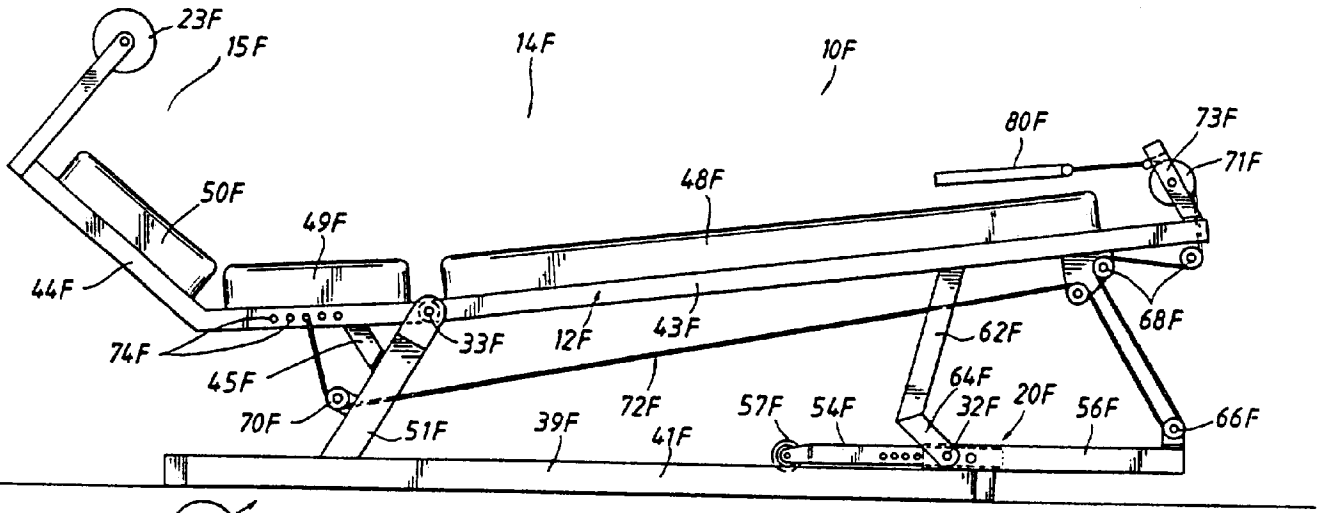
FIG. 13 is a side elevation of an additional embodiment of the exercise machine of this invention in which a lever adjacent an end of the platform has a roller on its lower end mounted on a rail of a supporting base for movement therealong upon raising of the platform by the user.
Figure 14:
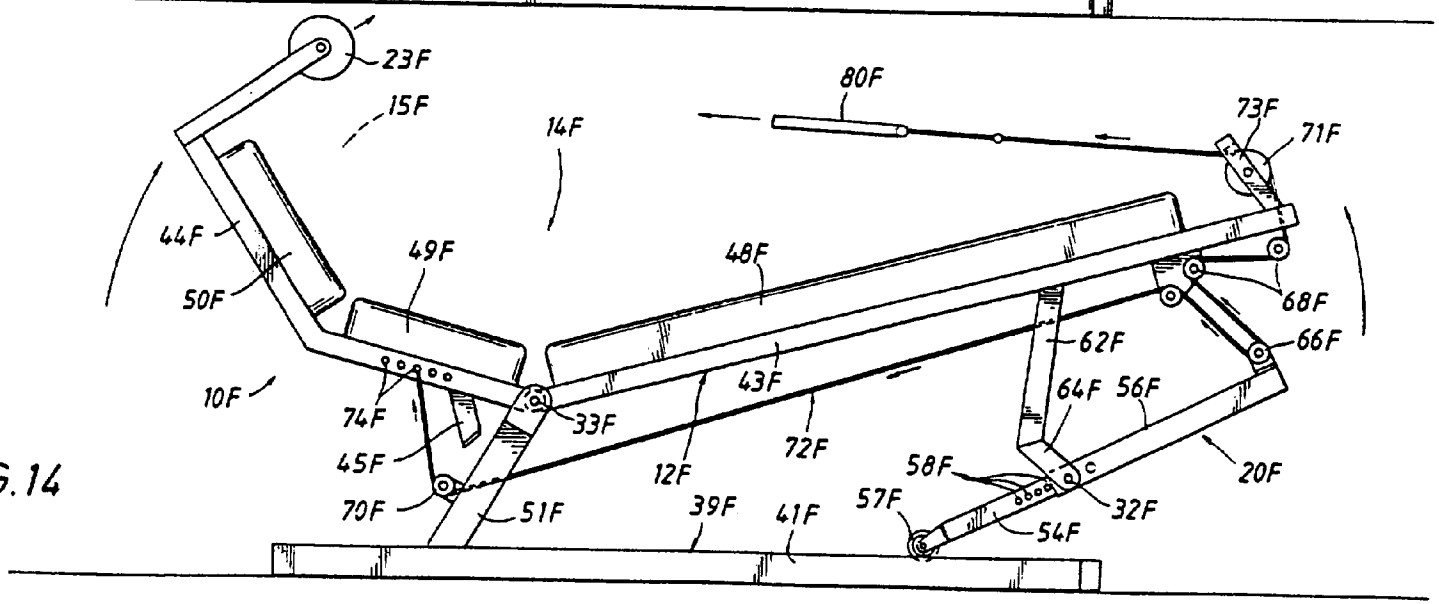
FIG. 14 is a side elevation of the exercise machine of FIG. 13 in which the lever is raised by the user from a manual pulling action and a thigh lifting action to lift the associated end of the platform with a roller on the end of the lever riding along the rail on the base.

Embodiment of FIGS. 13 and 14

FIGS. 13 and 14 show a further embodiment of the invention in which a supporting base is provided having a rail supporting an adjustable lever for back and forth movement thereon during actuation of the exercise apparatus. As illustrated, exercise apparatus 10F includes a platform 12F supported on a support base generally indicated at 39F on a supporting surface, such as the floor, and having a rail 41F. Platform 12F includes a main platform portion 43F having a pad 48F secured thereto and a rearwardly extending portion 44F having pads 49F and 50F secured thereon. A rear leg 51F secured to support base 29F is connected to platform 12F about pivot axis 33F. Rear platform portion 43F is mounted for pivotal movement about pivot 33F relative to main platform portion 43F. Support pads 48F, 49F, and 50F support the body of user 14F thereon in a supine position with pad 49F supporting the lower torso and pad 50F supporting the thighs of user 14F. A leg pad 23F is mounted above platform 12F for contact by the thighs 15F of user 14F.

A depending leg 45F is secured to rear platform portion 44F for limiting downward movement of platform portion 44F by contact with upstanding frame member 51F. Thus, upward pivotal movement of platform portion 44F provides a lifting action against the body of user 14F as shown in FIG. 14.

A lever 20F has inner and outer telescoping portions 54F and 56F which are longitudinally adjustable. A roller 57F is mounted on the end of inner lower telescoping portion 54F for rolling motion along rail 41F. A plurality of spaced openings 58F are provided in lower lever portion 54F and an adjustable pivot pin or rod 32F is mounted on the end of a downwardly extending leg 62F secured to platform 12F. Arm 62F has a lower crank portion 64F which includes pivot 32F on its lower end. A pulley 66F is secured to an extending end of upper (ever portion 56F. Pulleys 68F are secured to platform 12F and a pulley 70F is secured to rear leg 51F. A pulley 71F is mounted on an arm 73F extending from an end of platform 12F. A cable indicated generally at 72F has one end anchored in a selected opening 74F of platform 12F. Cable 72F extends about pulleys 70F, 66F, 68F, 71F and has a hand strap 80F at its free end.

In operation, user 14F grips hand strap 80F and exerts a pulling force thereon while simultaneously exerting a lifting force from thighs 15F against pad 23F to tension cable 72F and raise lever 20F from pulley 66F with roller 57F on an end of lever portion 54F rolling a small distance along rail 41F on base 39F.

Increased resistance to the exercises resulting from the weight of user 14F may be selected by the user by increasing the distance between pivot 32F and roller 57F of lever 20F.

The thigh action exerted against pad 23F and cable 72F is opposed to the pulling action exerted by hand strap 80F and cable 72F by user 14F, but both actions tension cable 72F to exert a lifting action on pulley 66F from cable 72F for raising the extending end of lever 2OF and platform 12F as indicated in FIG. 14. Additionally, rear platform portion 44F is pivoted about pivot 33F. User 14F may exert a pulling action on hand strap SOF either separately or simultaneously with a lifting action by thighs 15F against roller pad 23F. Likewise, the lifting action exerted by thighs 15F against pad 23F may be provided separately, or omitted as desired.

Figure 15:
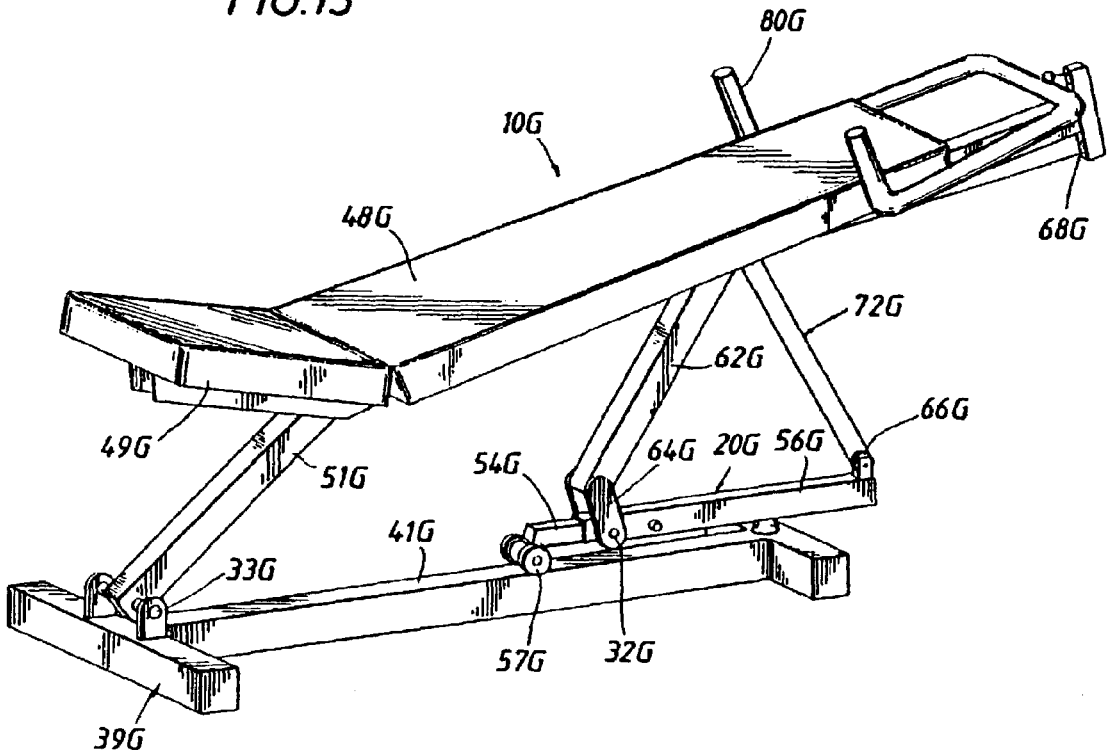
FIG. 15 is a perspective of a further embodiment of the invention in which the lever has a roller mounted on a supporting rail for movement therealong with the lever including a pair of telescoping portions.
Figure 16:
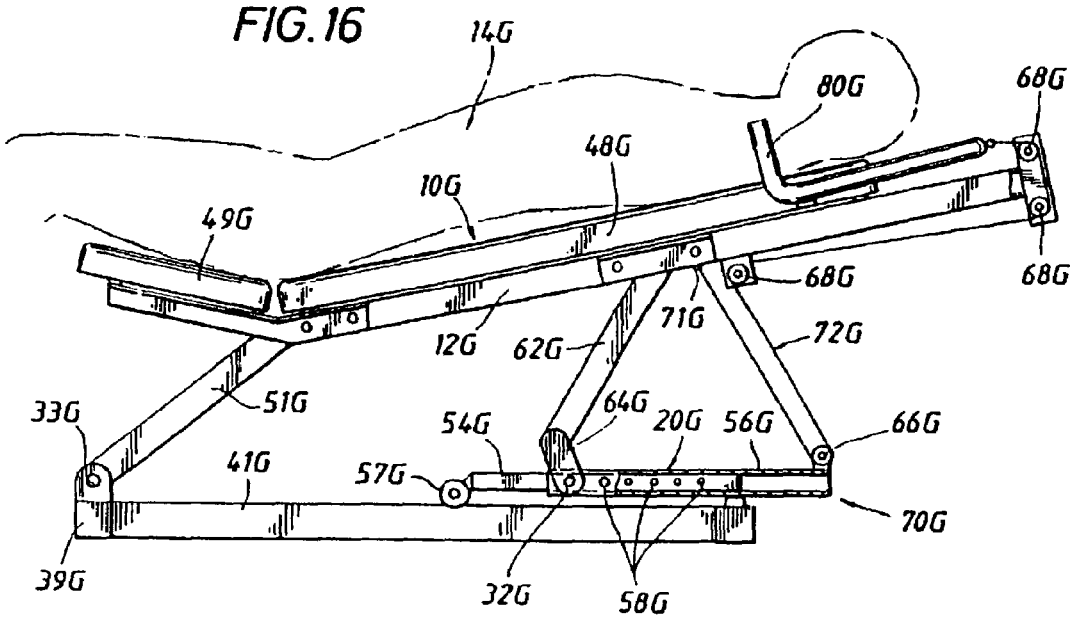
FIG. 16 is a side elevation of the exercise machine shown in FIG. 15.

Embodiment of FIGS. 15 and 16

Referring now to FIGS. 15 and 16, another exercise machine 10G is shown in which platform 12G includes pads 48G and 49G thereon. A base support 39G provides a rail 41G on which roller 57G of lower telescoping lever arm 54G is mounted for back and forth movement. Telescoping lever portions 54G and 56G of lever arm 2OG are mounted for lengthwise adjustment relative to each other in the same manner as the embodiment of FIGS. 13 and 14. Arm 62G secured at its upper end to platform 12G has a crank arm 64G at its lower end pivotally connected at 32G to lever 20G. Upstanding rear leg 51G is secured to platform 12G adjacent one end thereof and is pivotally mounted at 33G adjacent its lower end to base support 39G. Pulley 66G is mounted on the extending end of lever portion 56G and pulleys 68G are mounted on platform 12G. A cable 72G is anchored at 71G to platform 12G and its free end is secured to handle bar 80G, having a pair of hand grips thereon. Upon pulling on handle 8OG by user 14G, cable 72G raises lever 2OG by virtue of the force applied at pulley 66G with roller 57G rolling a small distance on rail 41G and platform 12G pivoting about pivot 33G during raising of lever 2OG and platform 12G.

In operation, user 14G grips the hand grips on handle bar 8OG and exerts a pulling action to tension cable 72G and lift pulley 66G to rotate lever 2OG about pivot 32G with roller 57G rolling a small distance along rail 41G. Platform 12G is raised against the weight of user 14G upon raising of lever 2OG and leg 51G pivots about pivot 33G upon raising of platform 12G. Selective resistance is achieved by varying the moment arm of lever 2OG by varying the position of pin or rod 32G in holes 58G. By so doing, the torque required to lift the machine, exerted by the force via cable 72 acting at end 7OG times the distance to roller 57G must be equal to or greater than the torque tending to maintain the machine at rest or at the bottom position. Such force is roughly equal to the weight of the user 14G times the distance of pin 32G to roller 57G. Accordingly, the smaller the ratio of the distance from pin 32G to roller 57G to the distance from end 7OG to roller 57G, the easier it is for the user to pivot platform 12G about pivot 33G.

Figure 17:
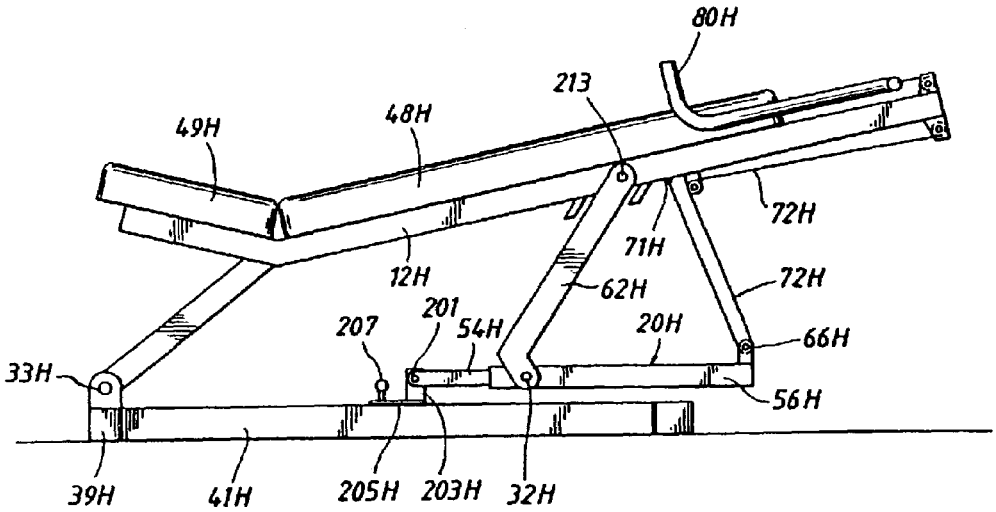
FIG. 17 is a side elevation of a further embodiment of the invention of which the machine of FIG. 16 is modified such that the lever is supported from a supporting rail by means of a pivot point which may be fixed to different points along such rail.

Embodiment of FIG. 17

The machine of FIGS. 15 and 16 may be modified as shown in FIG. 17. Rather than the selective positioning of crank 64G in holes 58G of FIG. 16, the machine 17 provides plate 205H with a prig loaded pull pin 207 mounted thereon such that the plate may be selectively fixed at different positions in holes along rail 41H. By so doing extension 54H telescopes within cylindrical arm 56H of lever 20H so as to shorten or lengthen the lever arm between pivot 201 of extension 54H and pulley 66.

In operation, when a user pulls on hand grips 80H, the cable 72H is tensioned tending to raise the platform 12H and the weight of the exerciser about pivot 201. Arm 62H pivots with respect to platform 12H at pivot 213 and with respect to lever 20H at pivot 32H.

Figure 18:
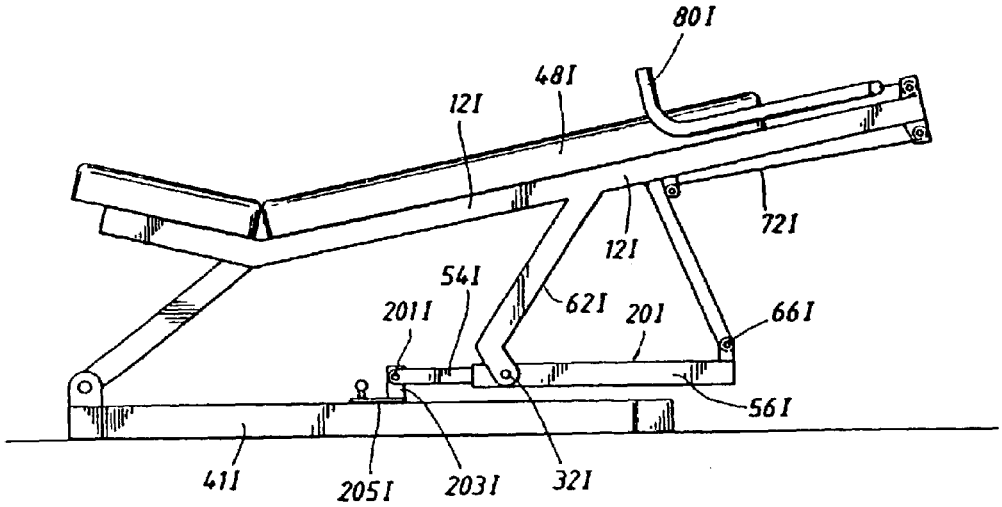
FIG. 18 is a side elevation of a further embodiment of the invention of which the machine of FIG. 16 is modified in a manner similar to that of FIG. 17 but with the elimination of one pivot for the connecting link between the rail and the lever arm.

Embodiment of FIG. 18

The machine of FIG. 18 is similar in all respects to the embodiment of FIG. 17, but arm 621 is pivoted to lever arm 201 at pivot 321 and is not pivoted with respect to platform 121.

In operation, when a user pulls on hand grips 801, the cable 721 is tensioned tending to raise the platform 121 and the weight of the exerciser about pivot 201. Arm 621 pivots with respect to lever arm 201 at pivot 321. As platform 121 is raised and lowered, extension 541 reciprocates within cylindrical lever portion 561.

Embodiment of FIGS. 19–22

Figure 19:
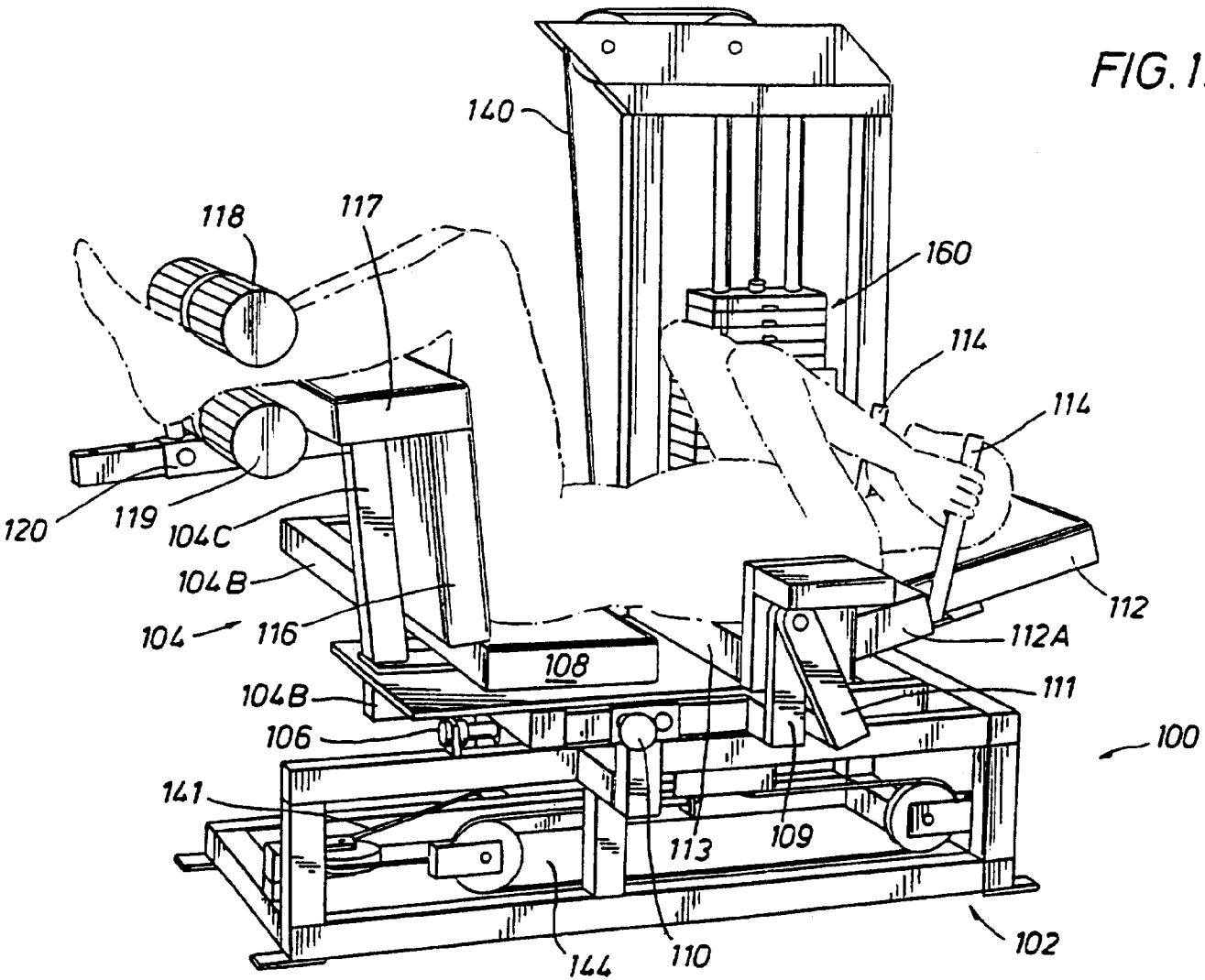
FIG. 19 is a front perspective view of a further embodiment of an exercise machine according to the invention with the provision of a weight stack for further resisting exertion by the lower limbs and/or by the upper limbs of a user supported in a reclining position.

FIGS. 19, 20, 21 and 22 show an exercise machine 100 having a base structure 102 on which a support frame 109 is mounted by means of linear bearing assembly 106. Such bearing assembly allows the support frame 109 to be moved horizontally with respect to base 102 to adjust the machine for users with different heights. A locking knob and pin assembly 110 may be used for slidable adjustment of the support frame 109. A rotating back frame 111 is pivoted at 150 to frame member 109. Rotating back frame plates 111C are disposed on rotating back frame 111 and head frame 111B is carried outwardly from rotating back frame 111. As best seen in FIG. 19, pad 112 is placed over plates 111C and is designed and arranged to support a user's upper back and head and to move upwardly and downwardly as rotating back frame 111 pivots up and down with respect to frame 109. Handles 114 are carried by head frame 111B.

A plate 109A is fixed to support frame 109 for mounting pad 113 which is stationary during exercise but moves horizontally during adjustment of support frame 109. Lower body support frame 104 is pivoted to frame 102 via structural member 102A (FIGS. 20, 21) by pivot and main shaft 130. Such pivot and main shaft 130 supports the lower body support frame 104 and allows the frame 104 to pivot with respect to frame 102. Pillow blocks 134A, 134B allow shaft 130 to rotate with frame member 104A and simultaneously carry cam 136. Cam 136 is secured to shaft and pivot 130 and rotates with it. Lower body support pads 108, 116, 117 are carried by structural members of lower body support frame 104. Adjustable foot restraint pads 118, 119 are coupled to support member 120 which is carried by, structural member 104C from lower body support frame 104.

Figure 21:
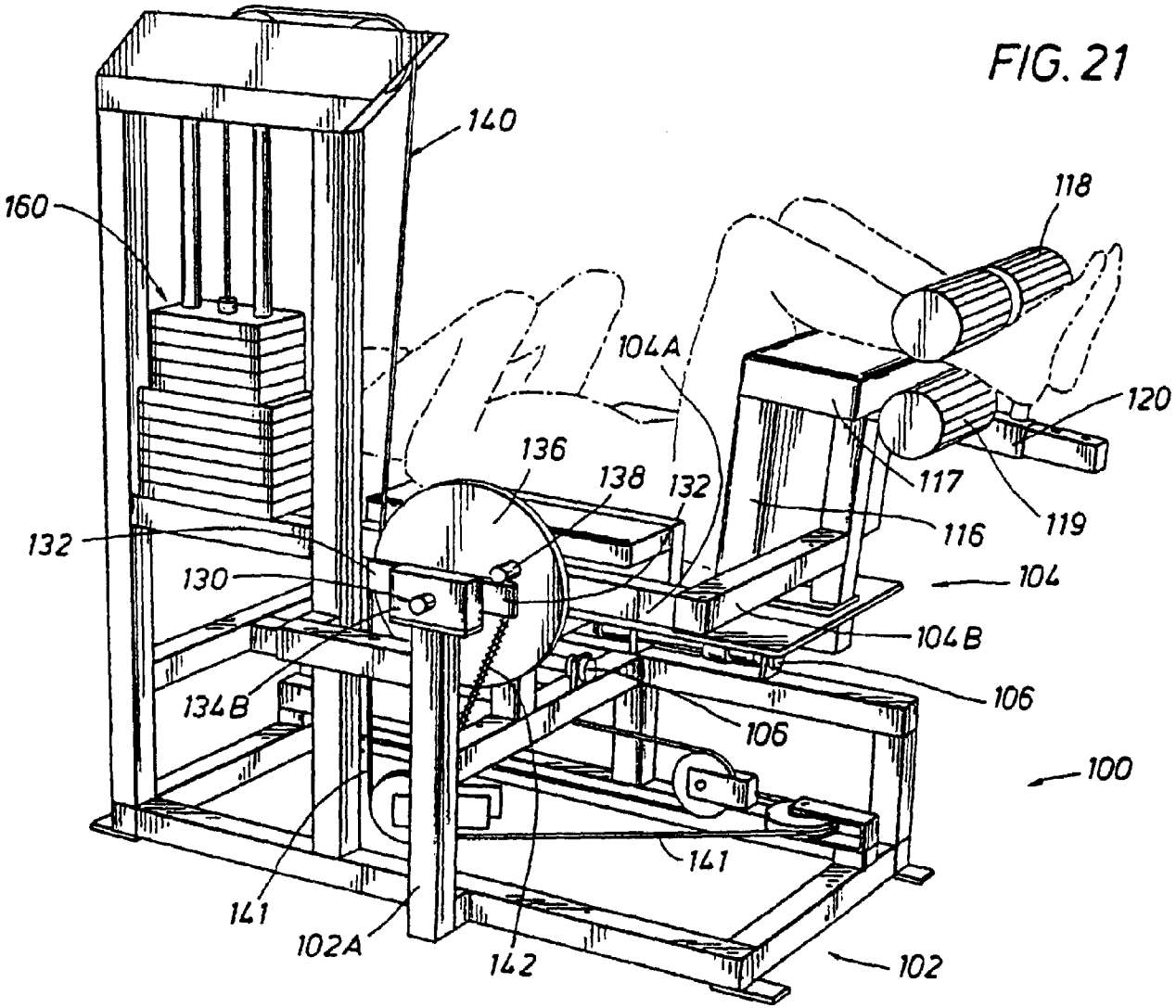
FIG. 21 is a rear perspective view of the exercise machine of FIG. 19 which illustrates the connection of a cable-pulley system connected from an upper body rotating frame to a cam-cable/pulley/weight stack assembly.
Figure 22:
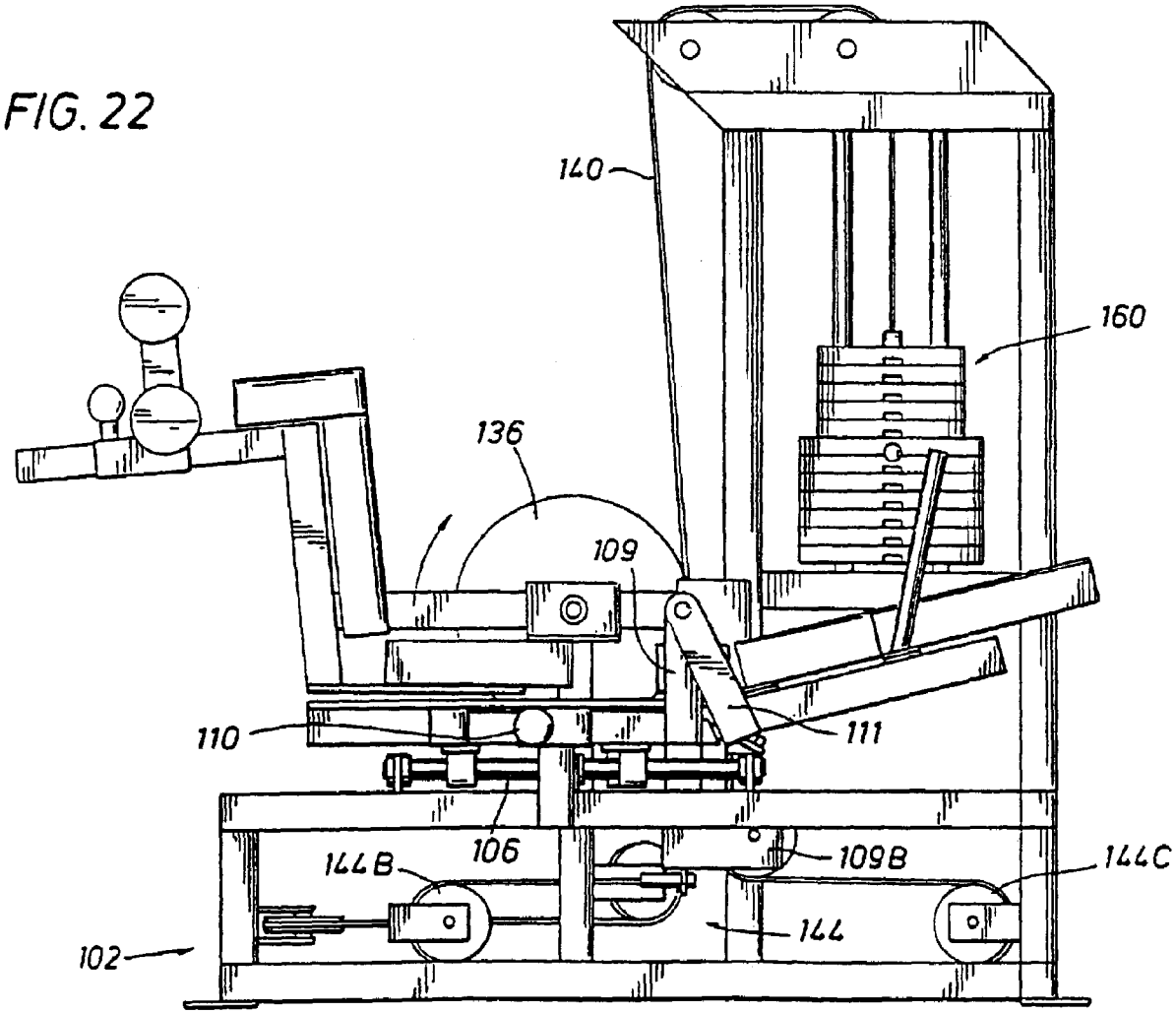
FIG. 22 is a front view of the exercise machine of FIG. 19 which illustrates the connection of the cable assembly to the upper body rotating frame of the machine.
Figure 23:
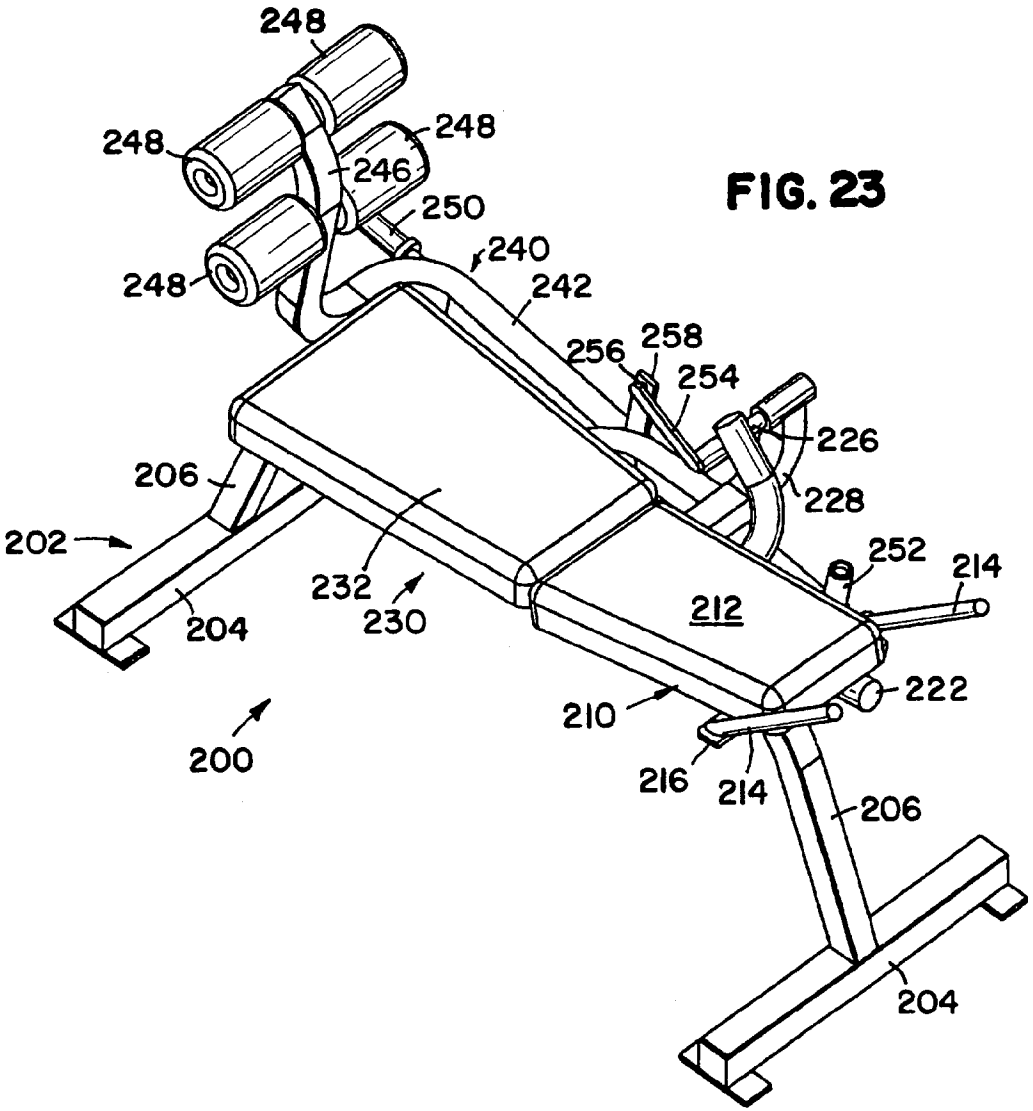
FIG. 23 is a perspective of an additional embodiment of an exercise machine according to the present invention in which a connecting linkage between the upper back support and the lower body actuator provides a coordinated movement of the upper back support and the lower body actuator.
Figure 24:
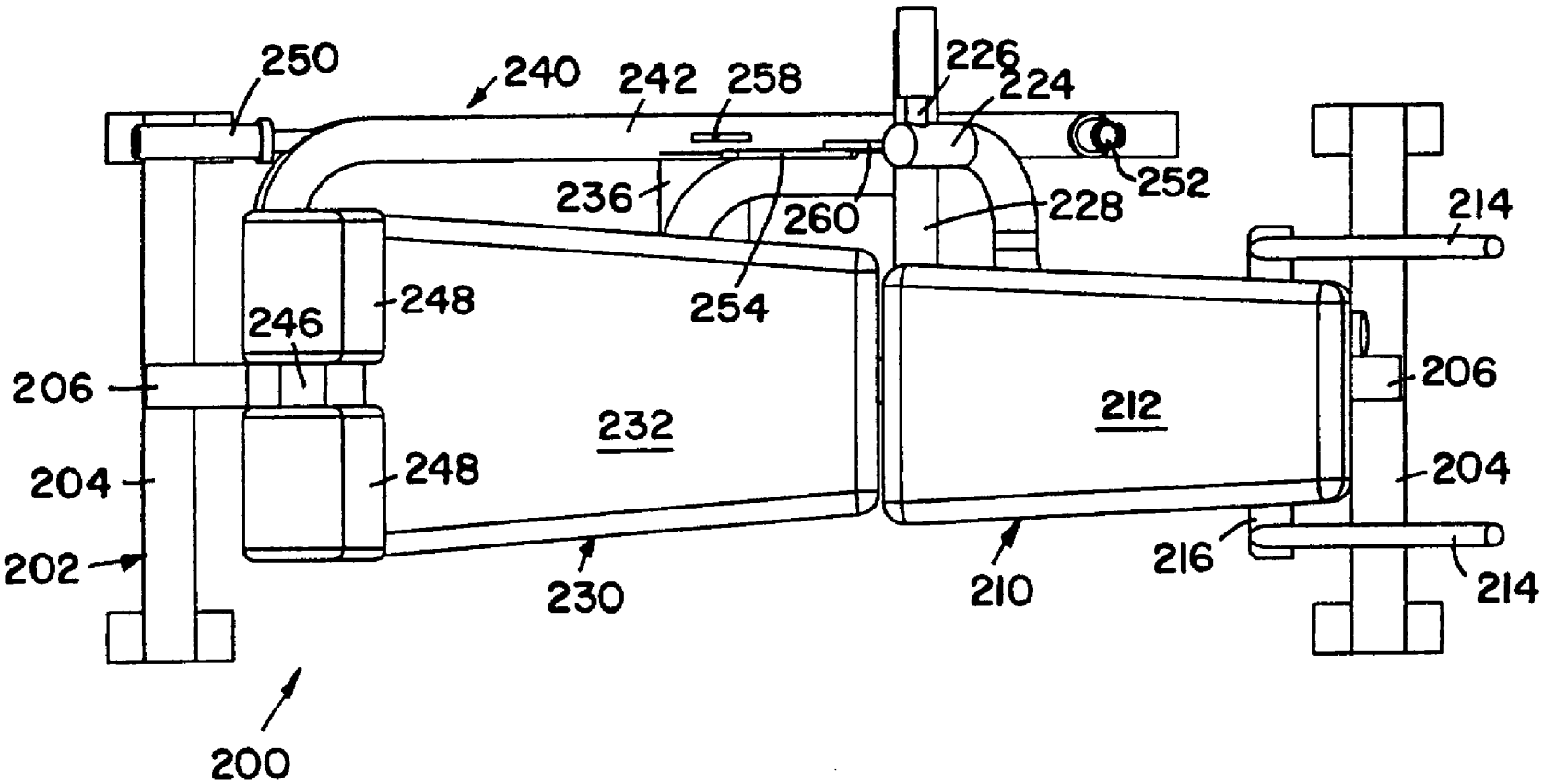
FIG. 24 is a top plan of the exercise machine shown in FIG. 23.

As best seen in rear view FIG. 21 and front views 19, 20, an upper body cam lever 132 is mounted on shaft 130 and is free to rotate about shaft 130. A cable 141, attached to cam lever 132, runs via a pulley system to adjustable cable-pulley arrangement 144, which is connected to rotating frame 111 as illustrated in FIG. 22. When upper body handles 114 are pulled upwardly, the cable-pulley arrangement 144 and cable 141 forces upper body cam lever 132 down. An extension 132A of upper body cam lever 132 is forced upward against engagement pin 138 on cam 136 thereby forcing it upwardly, causing cam 136 to rotate. A cable 140 is trained about the outer periphery of cam 136 and runs via a conventional cable pulley system to weight stack 160. Accordingly, upward rotation of the upper body frame 111, by virtue of a user's force against handles 114, is translated to an upward force against weight stack 160 which, of course, resists such upward force and rotation of frame 111.

Upward rotation of lower body frame 104 tends to rotate shaft 130 and also cam 136. Again, rotation of cam 136, and frame 104 about base 102 is resisted by weight stack 160.

An extension spring 142 connected between base 102 and lever extension 132A maintains tension on cable and pulley system 144 when lower body frame is rotated and back frame 111 remains stationary.

Figure 20:
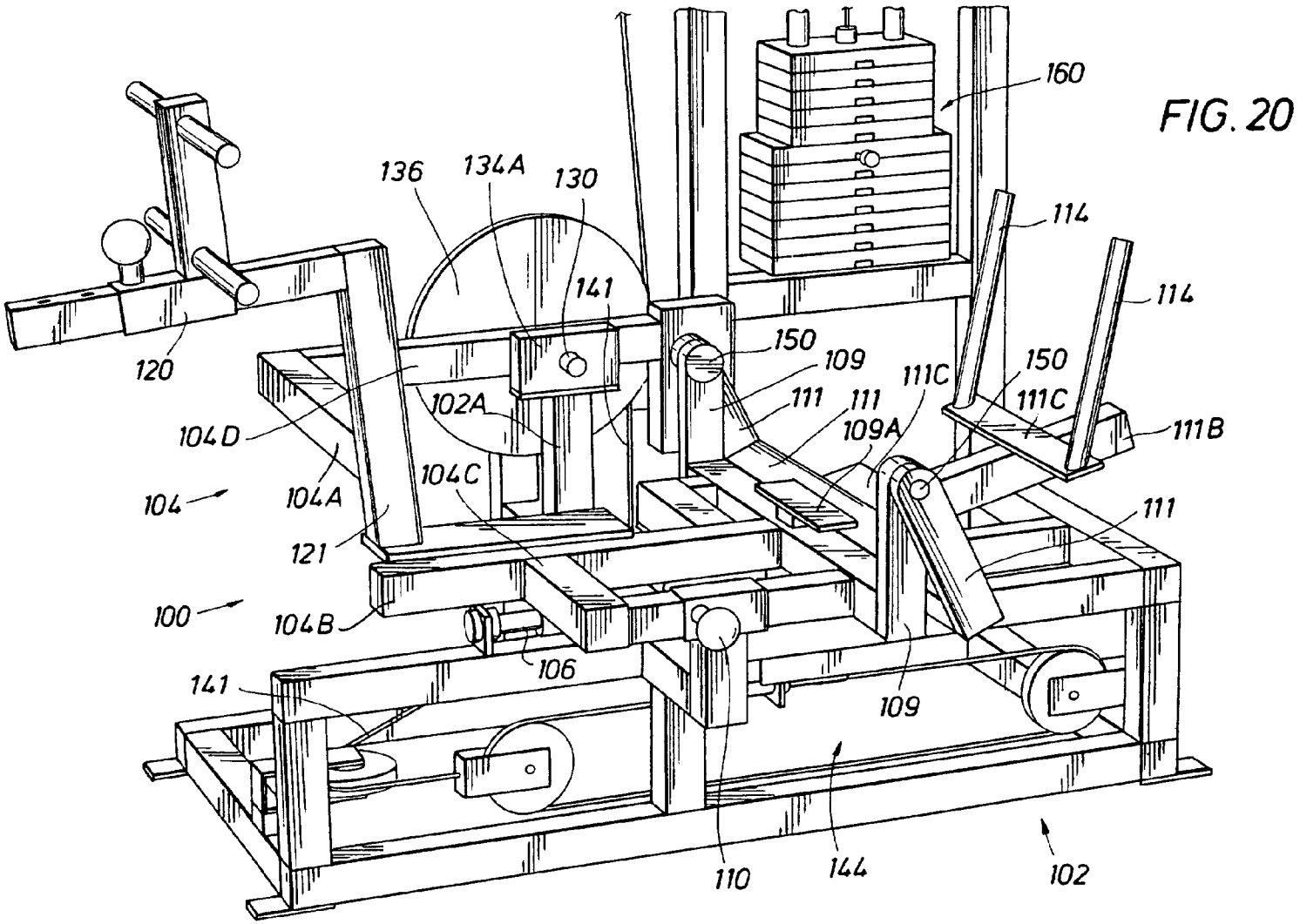
FIG. 20 is a front perspective view of the machine of FIG. 19, but with seat and comfort pads removed for better illustration of the underlying structures of the machine.

As best seen in FIG. 21 and FIG. 20 cable 141 is secured to cam lever 132. Cable 141 is attached to cable and pulley arrangement 144. Cable 144A loops around fixed pulley 144C and floating pulley 144B and has one end terminated at extension member 109B of frame 109 and the other end at rotating frame 111. (See FIG. 22) During horizontal adjustment since, both ends of cable 144A are attached to slidable adjustable extension 109B, frame 109 and rotating frame 111 no movement of floating pulley 144B takes places. During exercise however, extension 109B and frame 109 are locked from moving by pin 110 so activation of handles 114 and frame 111 pulls one end of cable 114A which pulls floating pulley 144B and cable 141 which rotates lower body frame 104 and lifts weight stack 160.

Embodiment of FIGS. 23–27

Referring now to the embodiment of the exercise machine shown in FIGS. 23–27, exercise machine 200 has a base frame 202 including lower support members 204 and an upper generally U-shaped support member 206 (best seen in FIG. 27) extending between base support members 204.

Figure 25:
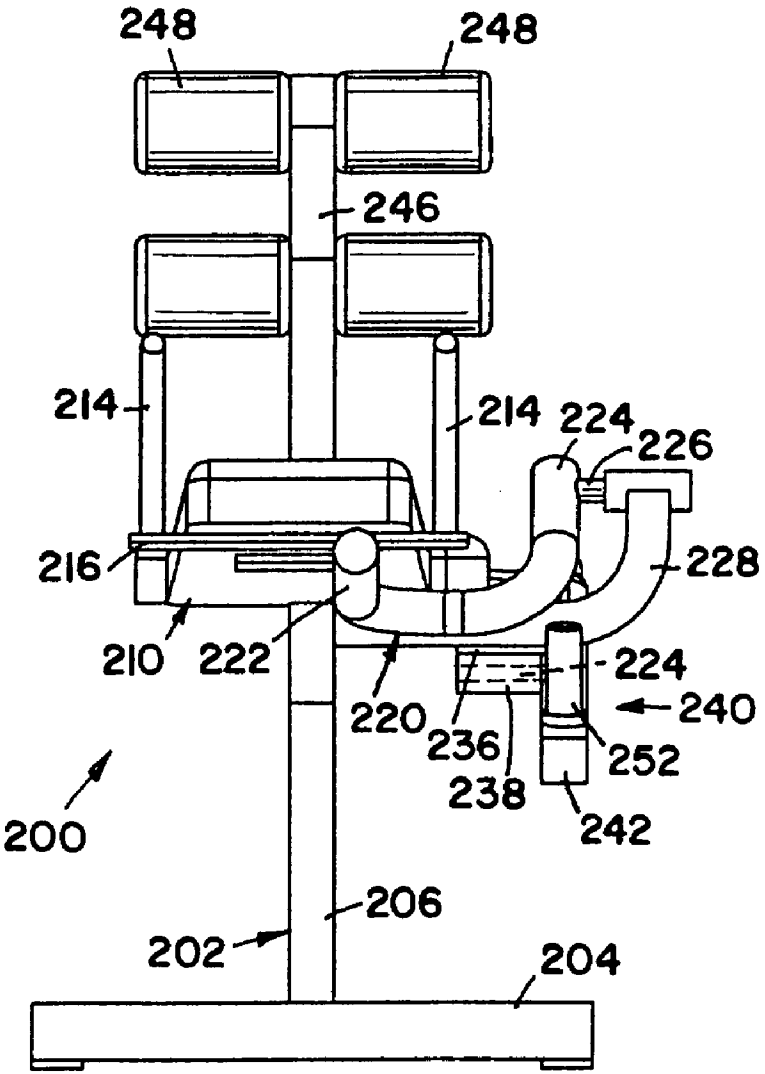
FIG. 25 is a front elevation of the exercise machine shown in FIGS. 23 and 24.
Figure 26:
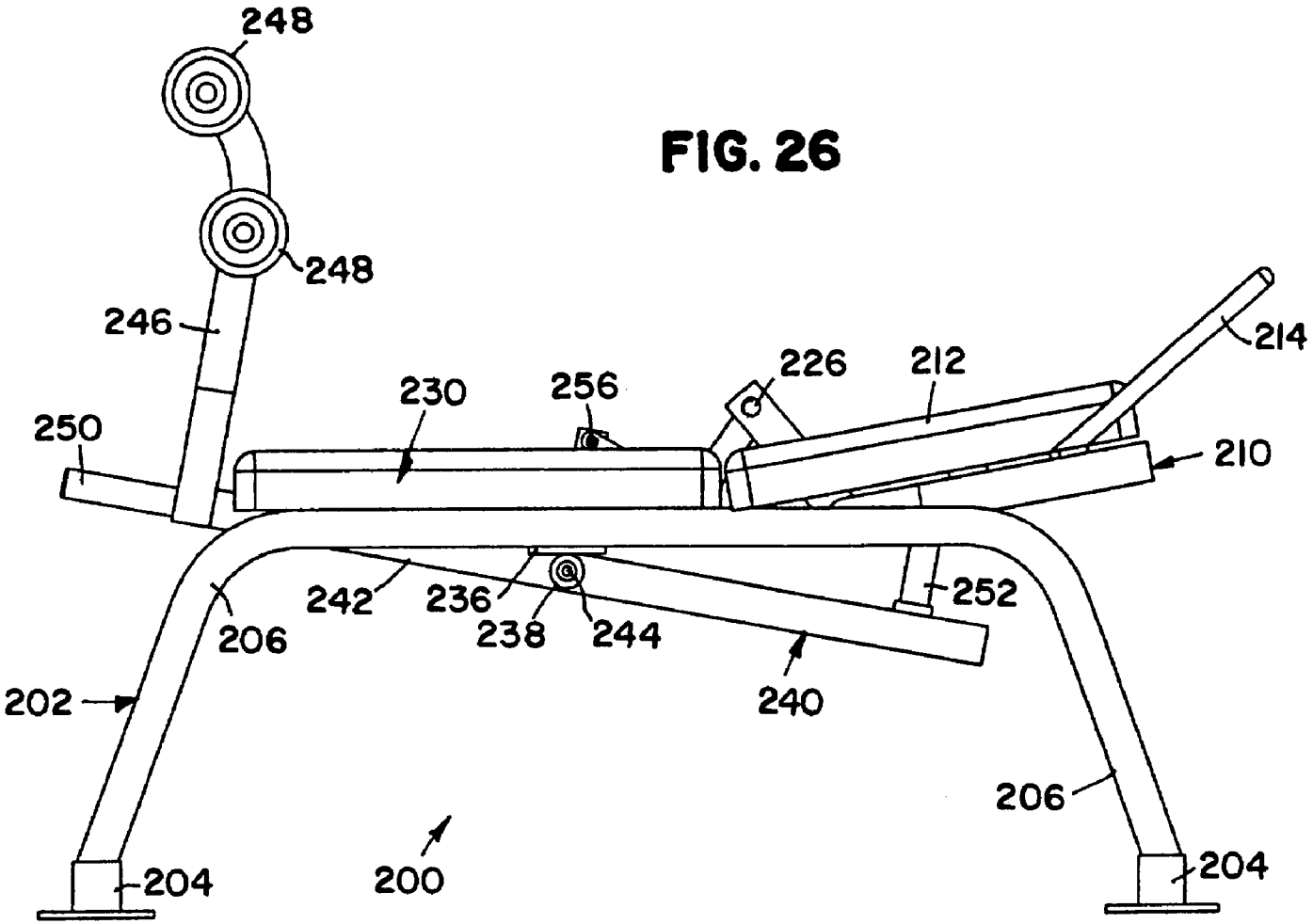
FIG. 26 is a left side elevation of the exercise machine shown in FIGS. 23–25.

An upper back support is shown generally at 210 having an upper seat pad 212 thereon. Upper back support 210 has a pair of handles 214 connected by a cross bar 216 as best seen in FIG. 25, in order to support back support 210 on base frame 202, a generally S-shaped tubular bar 220 has one end portion 222 secured to the lower side of back support 210 and an opposed end portion 224 mounted for pivotal movement on a shaft 226 which is supported on arm 228 and secured to U-shaped member 206 of base frame 202.

A lower back support generally indicated at 230 has an upper seat pad 232 thereon and is secured along its lower surface to U-shaped support member 206 of base frame 202.

A lateral support arm or plate 236 is fixed to U-shaped member 206 and extends laterally outward from member 206. Plate 236 supports a lower bearing sleeve or pillow block 238 as shown particularly in FIGS. 25 and 26. A lower body actuator generally indicated at 240 has a lower angle-shaped tubular support member 242. Tubular support member 242 is mounted intermediate its length about a pivot shaft 244 on pillow block 238 for relative rotative movement. Tubular support member 242 has an upwardly extending end portion 246 on which foot pads 248 are mounted. Suitable weights may be positioned on tubular support member 242 on opposed sides of pivot shaft 244 to assist or resist movement of foot pads 248. To resist upward movement of foot pads 248, weights may be positioned on weight support 250. To assist in the upward movement of foot pads 248, weights may be positioned on weight support 252.

Back support 210 and lower body actuator 240 are interconnected to provide a coordinated movement with movement of one resulting in a simultaneous movement of the other. For interconnecting back support 210 and lower body actuator 240, a connecting linkage is provided including a link 254 pivotally supported on pivot 256 which is mounted on upstanding arm 258 fixed to frame member 242. Link 260 is fixed to shaft 226 at one end and pivotally connected at 262 at its other end to link 254 as shown particularly in FIG. 27. Back support 210 and lower body actuator 240 move in unison toward each other upon a lifting force exerted by a user by gripping handles 214 and pivoting back support 210 upwardly or a lifting force exerted by the legs of a user against foot pads 248.

Figure 27:
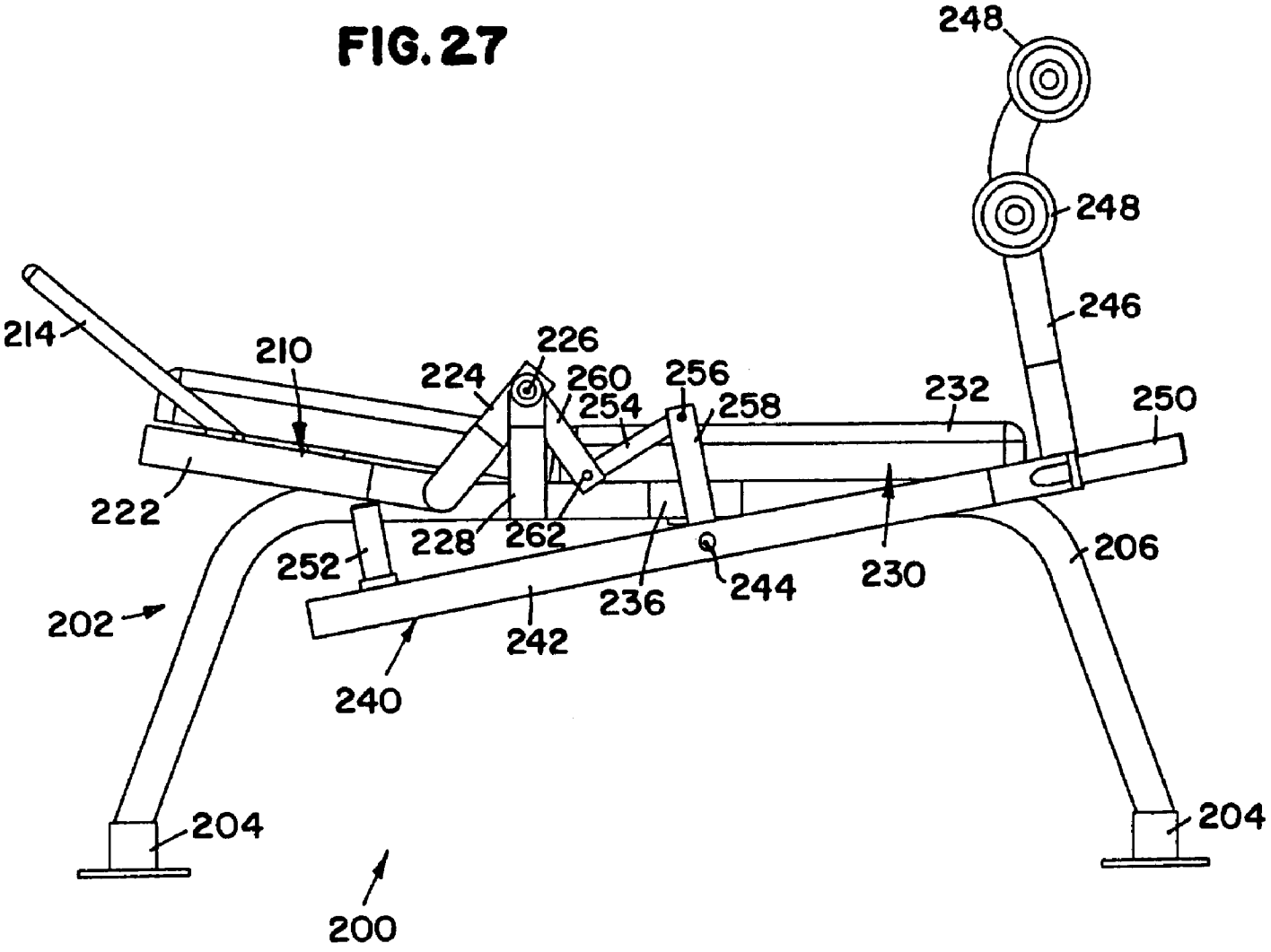
FIG. 27 is a right side elevation of the exercise machine shown in FIGS. 23–26.

As viewed in FIG. 27, upward movement of back support frame 210 by gripping handles 214 pivots back support 210 in a clockwise direction about pivot 226 causing lower body actuator 240 to pivot in a counterclockwise direction about pivot 244. Likewise, upward movement of foot pads 248 from force exerted by the legs of a user against foot pads 248 pivots or rotates lower body actuator 240 about pivot 244 in a counterclockwise direction for simultaneous rotation of back support 210 in a clockwise direction about pivot 226 as viewed in FIG. 27.

While several embodiments of the present invention have been illustrated in detail, it is apparent that modifications and adaptations of the embodiments shown will occur to those skilled in the art. However, it is to be expressly understood that such modifications and adaptations are within the spirit and scope of the present invention as set forth in the following claims.

What is claimed is:

1. An exercise machine, comprising:

a frame adapted to occupy a fixed position on a floor surface;

a body support pivotally connected to the frame at a first pivot axis, wherein the body support includes a back engaging surface;

at least one handle operatively connected to the body support;

at least one leg support pivotally connected to the frame at a discrete, second pivot axis, and linked to the body support; and a user adjustable number of weights operatively connected to the body support to resist pivoting of the body support upward about the first pivot axis.

2. An exercise machine, comprising:

a frame adapted to occupy a fixed position on a floor surface;

a body support pivotally connected to the frame at a first pivot axis, wherein the body support includes a back engaging surface;

at least one handle operatively connected to the body support;

at least one leg support pivotally connected to the frame at a discrete, second pivot axis, and linked to the body support; and an adjustable number of weights operatively connected to the at least one lea support to resist pivoting of the at least one leg support upward about the second pivot axis.

3. An exercise machine, comprising:

a frame adapted to occupy a fixed position on a floor surface;

a body support pivotally connected to the frame at a pivot axis, wherein the body support includes a back engaging surface;

at least one handle operatively connected to the body support for grasping by a person positioned with his back against the back engaging surface, thereby allowing the person to pull the body support upward about the pivot axis; and an adjusting means for adjusting how much user exerted force must be applied against the handle in order to pivot the body support upward about the pivot axis, wherein the adjusting means is operable to resist upward pivoting of the body support in a first mode of operation, and to assist upward pivoting of the body support in a second mode of operation.

4. The exercise machine of claim 3, wherein the adjusting means includes a lever arm having an intermediate portion pivotally connected to the frame, and opposite ends adapted to selectively support at least one weight.

5. The exercise machine of claim 3, further comprising a leg support operatively connected to the lever arm.

6. An exercise machine, comprising:

a frame adapted to occupy a fixed position on a floor surface;

a body support pivotally connected to the frame at a first pivot axis, wherein the body support includes a back engaging surface;

a leg support pivotally connected to the frame at a discrete, second pivot axis, and linked to the body support in a manner that constrains the leg support and the body support to pivot in opposite directions; and an adjusting means for adjusting how much user exerted force must be applied against the handle in order to pivot the body support and the leg support toward one another, wherein the adjusting means is biased against pivoting of the leg support and the body support toward one another in a first mode of operation, and is biased in favor of pivoting of the leg support and the body support toward one another in a second mode of operation.

7. An exercise machine, comprising:

a frame adapted to occupy a fixed position on a floor surface;

at least one handle pivotally mounted on the frame for pivoting about a first pivot axis;

at least one leg support pivotally mounted on the frame for pivoting about a discrete, second pivot axis;

a linking means for linking the at least one handle to the at least one leg support in a manner that constrains the at least one leg support to pivot in a first direction in response to pivoting of the at least one handle in an opposite, second direction; and a body support rigidly mounted on the frame between the at least one leg support and the at least one handle.

8. The exercise machine of claim 7, wherein the body support includes a padded member that faces upward away from the floor surface.

9. The exercise machine of claim 7, wherein the at least one leg support includes a main bar, left and right lower bars projecting outward from opposite sides of the main bar to support a person's legs in a rest position, and left and right upper bars projecting outward from opposite sides of the main bar to receive a pulling force directed through a person's legs.

10. An exercise machine, comprising:

a frame adapted to occupy a fixed position on a floor surface;

at least one leg support pivotally mounted on the frame for pivoting about a pivot axis;

at least one handle;

a linking means for linking the at least one handle to the at least one leg support in a manner that constrains the at least one leg support to move in a first direction in response to pivoting of the at least one handle in an opposite, second direction; and a body support rigidly mounted on the frame in a manner that provides a stationary, upwardly facing seat pad.

11. The exercise machine of claim 10, wherein the at least one leg support includes a main bar, left and right lower bars projecting outward from opposite sides of the main bar to support a person's legs in a rest position, and left and right upper bars projecting outward from opposite sides of the main bar to receive a pulling force directed through a person's legs.

12. An exercise machine, comprising:

a frame adapted to occupy a fixed position on a floor surface;

a body supporting assembly mounted on the frame, wherein the assembly includes an upper body support sized and configured to support a person's upper back and having at least one arm support secured thereto, a lower body support sized and configured to support a person's legs and having at least one leg support secured thereto, and an intermediate body support sized and configured to support a person's lower back, wherein the upper body support is pivotally connected to a first end of the intermediate body support, and the lower body support is pivotally connected to an opposite, second end of the intermediate body support; and a linking means for: linking the upper body support to the lower body support in a manner that constrains the lower body support to pivot in a first direction in response to pivoting of the upper body support in an opposite, second direction.

13. The exercise machine of claim 12, wherein the intermediate body support includes a padded member that faces upward away from the floor surface.

14. The exercise machine of claim 12, wherein the at least one leg support includes a central bar, left and right lower bars projecting outward from opposite sides of the central bar to support a person's legs in a rest position, and left and right upper bars projecting outward from opposite sides of the central bar to receive a pulling force directed through a person's legs.

15. An exercise machine, comprising:

a frame adapted to occupy a fixed position on a floor surface;

a body supporting assembly mounted on the frame, wherein the assembly includes an upper body support sized and configured to support a person's upper back and having at least one arm support secured thereto, a lower body support sized and configured to support a person's legs and having at least one leg support secured thereto, and an intermediate body support sized and configured to support a person's lower back, wherein the intermediate body support is disposed between the upper body support and the lower body support, and the upper body support pivots about a first pivot axis relative to the intermediate body support, and the lower body support pivots about a second pivot axis relative to the intermediate body support; and a separate linkage interconnected between the upper body support and the lower body support in a manner that constrains the lower body support to pivot in a first direction in response to pivoting of the upper body support in an opposite, second direction.

* * * * *